United States Patent [19]

Gamm et al.

[11] 4,257,414

[45] Mar. 24, 1981

[54] ATHLETIC PROTECTOR CUP

[75] Inventors: Paul B. Gamm, Cincinnati, Ohio; Elwood Strohm, Fort Thomas, Ky.

[73] Assignee: Jung Products, Inc., Cincinnati, Ohio

[21] Appl. No.: 53,070

[22] Filed: Jun. 28, 1979

[51] Int. Cl.[3] ..... A61F 5/40

[52] U.S. Cl. ..... 128/160

[58] Field of Search ..... 128/158–162, 128/206.24, 206.12; 2/2 R

[56] References Cited

U.S. PATENT DOCUMENTS

| | | | |
|---|---|---|---|
| 2,283,684 | 5/1942 | Matthews | 128/160 |
| 3,176,686 | 4/1965 | Barnes | 128/158 X |
| 3,688,768 | 9/1972 | Reimschussel et al. | 128/206.12 |
| 4,134,400 | 1/1979 | DiMatteo | 128/158 |

*Primary Examiner*—John D. Yasko

*Attorney, Agent, or Firm*—Frost & Jacobs

[57] ABSTRACT

An athletic protective device comprising an essentially rigid cup of a size to enclose the genitals of the wearer, a flexible resilient molded binding secured to the periphery of the cup, the binding preferably being configured to provide a relatively thick body portion lying immediately beyond the peripheral edge of the cup, the binding flaring outwardly to form a relatively thin marginal lip adapted to contact the groin area of the wearer, the cup preferably having a plurality of closely spaced apart perforations extending about its periphery with the molded binding material extending through the perforations to form interlocks integrally joining the portions of the binding lying on opposite sides of the cup.

9 Claims, 6 Drawing Figures

ATHLETIC PROTECTOR CUP

BRIEF SUMMARY OF THE INVENTION

This invention relates to protective cups for the groin region of male athletes. Such cups are widely utilized to avoid injury to the wearer, the cup being in the nature of a rigid plastic closure which protects the genitals from impact. Protector cups of this character are usually formed from a plastic material which is sufficiently rigid to retain its shape even when struck a relatively severe blow.

Customarily, the protector cup is provided at its periphery with resilient padding both for the comfort of the wearer and, in some measure, to absorb the impact of a blow to the protector cup. The resilient padding is usually formed from a soft, flexible foam-like material, such as foam rubber or polyurethane foam, and is usually provided in the form of an elongated strip of generally circular configuration having a radially extending slot by means of which the padding is engaged about the peripheral edge of the protector, a suitable length of padding being hand fitted to the protector and adhesively secured in place. Such procedure is both time consuming and costly, and additionally the bond between the padding and the protector cup is often deficient or becomes so during repeated use of the protector, the padding peeling away from the cup.

In order to provide effective cushioning, the padding is bulky and is often uncomfortable. While intended to absorb shock, the padding, being relatively soft, will readily compress and flatten when subjected to impact, resulting in the transmittal of a substantial portion of the impact force to the groin area of the wearer.

The present invention overcomes the difficulties experienced with presently known protective cups by providing a protective peripheral binding which is molded to the cup, the peripheral edges of the cup being provided with a series of closely spaced apart perforations through which the binding material flows during the molding operation, thereby securely and permanently locking the binding to the cup, the material from which the binding is formed preferably being of a type which will also bond to the surfaces of the cup which it contacts. The binding is thus securely bound to the cup and, by reason of the binding being applied by a molding operation, the hand cutting, fitting and adhesive attachment of the conventional padding are eliminated with substantial savings in production costs.

The use of a molded binding also permits the binding to be shaped and contoured so as to enhance its cushioning effect as well as the comfort of the wearer. In particular, it has been found that by contouring the binding so that it flares outwardly from a relatively thick body portion adjacent the periphery of the cup to a relatively thin flange-like outermost edge, the ability of the binding to absorb and dissipate the impact of a blow to the protector is materially enhanced, the contour of the binding effecting a gradual build-up in pressure against the groin area as a blow is struck. In addition, the thin outermost edge of the binding fits comfortably against the wearer's body and does not produce the objectionable bulky feeling of conventional padding. By contouring the binding in this manner additional protection is provided for the groin, particularly in the area of the inguinal ligaments.

DETAILED DESCRIPTION

Figure 1:
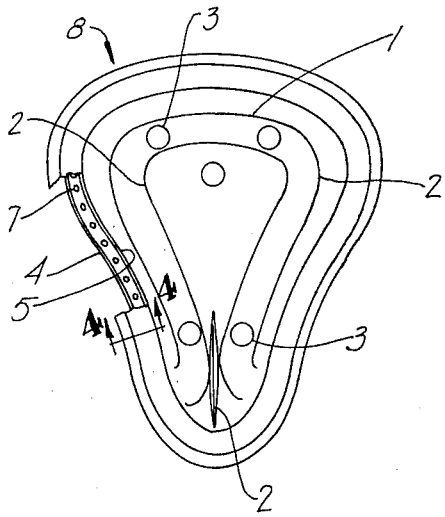
FIG. 1 is a front view of a protective cup in accordance with the invention with parts broken away.
Figure 2:
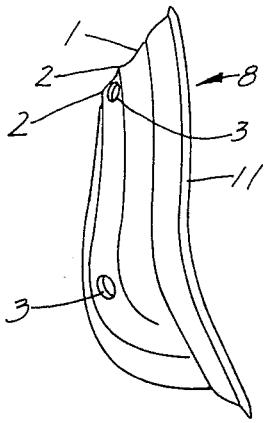
FIG. 2 is a side view thereof taken from the right side of FIG. 1.
Figure 3:
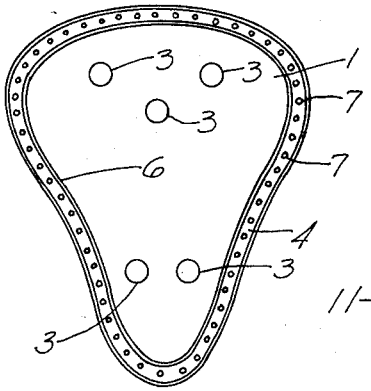
FIG. 3 is a rear view of the protector cup prior to the application of the protective binding.

Referring first to FIGS. 1 and 2 of the drawings, the protector comprises an essentially rigid cup-shaped body 1 which is contoured to cover and protect the genitals. The cup may be formed from numerous rigid plastic materials, such as polypropylene or high density polyethylene. In order to enhance the strength of the cup, it is preferred to provide a series of curvilinear ridges 2 on the exterior surface of the cup. The arrangement and number of the ridges does not constitute a limitation on the invention, although preferably they will be confined to the exterior surface of the cup and the interior surface will be smooth. The cup is also provided with a plurality of apertures 3 for ventilation purposes.

Figure 4:
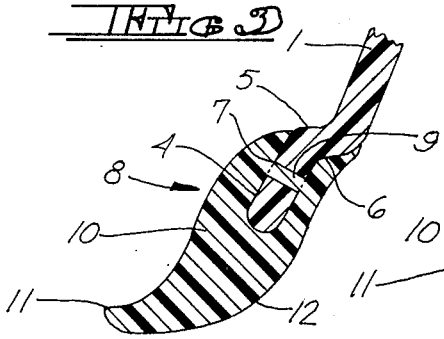
FIG. 4 is an enlarged fragmentary sectional view taken along the line 4—4 of FIG. 1.
Figure 5:
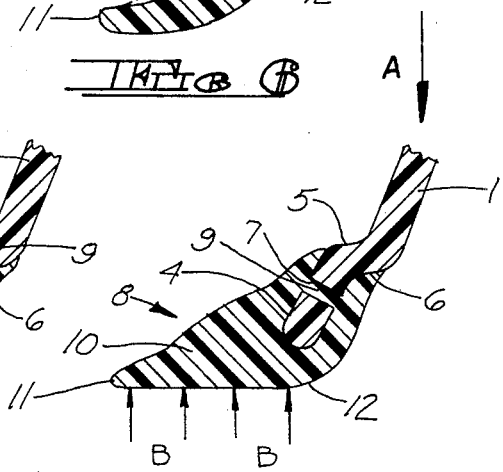
FIG. 5 is an enlarged fragmentary sectional view similar to FIG. 4 illustrating the manner in which the contoured binding reacts when subjected to impact forces.

As best seen in FIGS. 4 and 5, the cup is provided with a peripheral flange 4 which is offset relative to the body of the cup by outer and inner shoulders 5 and 6, respectively. The flange is provided with a series of closely spaced apart perforations 7 which may be of circular, oblong or other configuration. In an exemplary embodiment, the perforations are on 0.65 cm centers, the primary consideration being the provision of a sufficient number of perforations to insure that the binding will be firmly anchored to the cup.

The peripheral binding is indicated at 8, the binding being formed from a flexible resilient material, such as rubber or polyurethane. In accordance with the invention, the peripheral binding will be molded to the flange 4 of the cup, as by an injection or compression molding operation, and as will be evident from FIGS. 4 and 5, the binding material flows through the perforations 7 and hence provides interlocks 9 integrally connecting the portions of the binding lying on opposite sides of the flange 4. On its outer side, the binding terminates inwardly at the juncture of flange 4 and outer shoulder 5, whereas on its inner side the binding preferably terminates inwardly in abutting relation to shoulder 6, the shoulders serving as convenient "kiss-off" points for the mold which forms the binding and hence provides an essentially smooth transition from the body of the cup to the binding.

The binding is contoured to have a relatively thick body portion 10 lying immediately beyond the outermost peripheral edge of flange 4, the binding tapering outwardly to a relatively thin marginal flange or lip 11. On its inner surface, the binding extends downwardly and outwardly in a smooth curve 12. In normal use, the undersurface of the lip 11 will contact the wearer's body and will fit comfortably thereagainst, the thin flexible lip area conforming readily to the body contour. However, when the protector is subjected to sharp impact, as represented by the Arrow A in FIG. 5, it will be resisted by the wearer's body, as indicated by the Arrows B, and in so doing the relatively large body portion 10 of the binding will be progressively deflected to the condition illustrated in FIG. 5, the curved undersurface 12 of the binding compressing and flattening out in the manner illustrated, thereby distributing the impact forces. In contrast to conventional padding, a contoured binding in accordance with the invention acts as a spring-like leaf to effectively cushion the protector.

Figure 6:
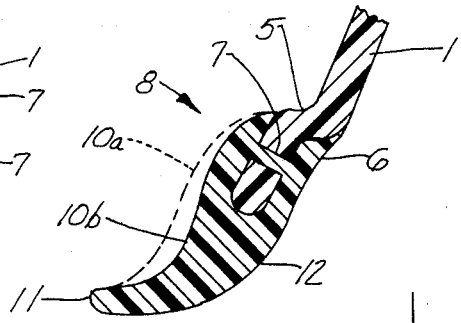
FIG. 6 is also an enlarged fragmentary sectional view similar to FIG. 4 illustrating the contouring of the binding to vary the pressure applied to the wearer's body at different locations.

In addition to contouring the binding to provide the thin marginal flange or lip 11, the body 10 of the binding also may be contoured to vary its thickness at different peripheral locations to thereby vary the amount of pressure the binding applies to the portions of the body which it contacts. For example, and as illustrated in FIG. 6, the body portion 10 may be reduced in thickness by the amount represented between broken line 10*a* and solid line 10*b* in the areas of the pubic ligaments, thereby decreasing the pressure applied to those ligaments during normal use. It should be evident that by controlling the thickness of the binding at selected areas about the periphery of the cup, the amount of resistance exerted by the binding can be varied as desired to provide optimum comfort and protection.

What is claimed is:

1. An athletic protector comprising an essentially rigid cup having a body of a size to enclose the genitals of the wearer, a plurality of closely spaced apart perforations extending about the periphery of the cup, a flexible resilient material molded to the periphery of the cup to provide a peripheral binding, the binding material overlying said perforations on both the outer and inner surfaces of the cup, with portions of the binding material extending through the perforations to form interlocks integrally joining the portions of the binding lying on opposite sides of the cup.

2. The athletic protector claimed in claim 1 wherein said peripheral binding is configured to provide a relatively thick body portion lying immediately beyond the peripheral edge of the cup, the binding flaring outwardly to form a relatively thin marginal lip adapted to contact the groin area of the wearer.

3. The athletic protector claimed in claim 2 wherein said essentially rigid cup includes a peripheral flange offset relative to the body of said cup by outer and inner shoulders, wherein said perforations are formed in said peripheral flange, and wherein said binding terminates inwardly at said shoulders.

4. The athletic protector claimed in claim 3 wherein the binding terminates at the outermost edge of said outer shoulder and at the innermost edge of said inner shoulder.

5. The athletic protector claimed in claim 4 including a series of curvilinear reinforcing ridges formed on the outer surface of said cup, the inner surface of said cup being essentially smooth.

6. The athletic protector claimed in claim 5 including a plurality of apertures in said cup, said apertures lying intermediate said reinforcing curvilinear ridges.

7. The athletic protector claimed in claim 1 wherein the body portion of the binding is contoured to be of varying thickness about the periphery of the cup.

8. An athletic protector of a size to cover the genitals of the wearer, said protector comprising an essentially rigid cup having a peripheral edge, a flexible resilient molded binding secured to and covering the peripheral edge of said cup, said binding being configured to provide a relatively thick body portion lying immediately beyond the peripheral edge of said cup, the binding flaring outwardly relatively to said cup to provide a relatively thin marginal lip adapted to contact the groin area of the wearer.

9. The athletic protector claimed in claim 8 wherein the body portion of the binding is contoured to be of varying thickness about the periphery of the cup.

* * * * *